US005149155A

United States Patent [19]

Caeti et al.

[11] Patent Number: 5,149,155

[45] Date of Patent: Sep. 22, 1992

[54] LEVER HANDLE LOCK ASSEMBLY

[75] Inventors: Ben J. Caeti, Brooklyn, N.Y.; Paul Raybary, Roanoke, Va.; Boris Grinshpon, Brooklyn, N.Y.

[73] Assignee: Arrow Lock Manufacturing Company, Brooklyn, N.Y.

[21] Appl. No.: 713,111

[22] Filed: Jun. 14, 1991

[51] Int. Cl.[5] ..... E05C 1/16

[52] U.S. Cl. ..... 292/336.3; 292/357

[58] Field of Search ..... 292/169, 169.16, 169.22, 292/169.23, 336.3, 337, 347, 357

[56] References Cited

U.S. PATENT DOCUMENTS

| | | | |
|---|---|---|---|
| 348,656 | 9/1886 | Briggs . | |
| 1,042,297 | 10/1912 | Voight | 70/370 |
| 2,141,265 | 4/1937 | Dey | 292/357 |
| 2,238,066 | 10/1938 | Mantz | 292/337 |
| 2,759,754 | 2/1955 | Kaiser | 292/347 |
| 3,019,633 | 2/1962 | Russell et al. | 70/224 |
| 3,038,749 | 6/1962 | Check et al. | 292/337 |
| 3,210,976 | 10/1965 | Best | 70/224 |
| 3,846,255 | 8/1958 | Wardwell, Jr. | 292/169 |
| 3,955,387 | 5/1976 | Best et al. | 70/224 |
| 4,067,599 | 1/1978 | Ohno | 292/357 |
| 4,428,212 | 1/1984 | Best et al. | 70/224 |
| 4,597,600 | 7/1986 | Wilke et al. | 292/336 |
| 4,672,829 | 6/1987 | Gater et al. | 70/472 |
| 4,869,083 | 6/1989 | De Marseilles et al. | 70/224 |
| 4,877,278 | 10/1989 | Valley | 292/357 X |

FOREIGN PATENT DOCUMENTS 1197350 7/1965 Fed. Rep. of Germany .

*Primary Examiner*—Richard E. Moore

*Attorney, Agent, or Firm*—DeLio & Associates

[57] ABSTRACT

A cylindrical lock assembly for mounting in a door panel having a transverse bore includes a lock chassis adapted to fit within the bore which has lever handles on rotatable spindles for actuating a latch bolt. The chassis additionally has a support opening on at least the first side of the door panel. A support plate having a diameter greater than the bore is mounted on each side of the door panel and is non-rotatably secured to the panel. The support plate includes an opening corresponding to and aligned with the chassis support opening. A threaded support plate fastener having a hollow, elongated body with an internal opening extending along its length is adapted to extend through the opening in one of the support plates and into the chassis support opening to non-rotatably secure the chassis to the support plate. A rose through which a spindle extends for mounting on the door panel on the exterior side of each support plate is securable to the lock assembly by an threaded fastener extending through the hollow support plate fastener between the two roses.

20 Claims, 3 Drawing Sheets

LEVER HANDLE LOCK ASSEMBLY

BACKGROUND OF THE INVENTION

This invention relates to a cylindrical lock for mounting on a door panel and, in particular, to an improved cylindrical lock assembly with use lever-type handles.

Cylindrical locks utilized in exterior door applications must be made to withstand more severe environments and higher security usage than those utilized on interior doors, especially when lever-type handles are used. Potential damage can result from vandalism, burglary and general misuse and/or abuse, and such damage is often magnified by the availability of the lever handle to exert considerable torque on the lock assembly. Overloading of such lock assembly may jam and disable it, or damage it to the extent that the door may be forced open.

An improved cylindrical handle lock for heavy duty exterior door application has been disclosed in U.S. Pat. No. 4,869,083 to DeMarseilles, et al., the disclosure of which is incorporated herein by reference. This patent utilizes a pair of tongue members extending inwardly from support plates which mate with corresponding openings in the lock chassis. However, in order to provide for the greater resistance to damage in such heavy duty lock mechanisms, it is necessary to drill additional holes in the door panel outside of the bore which receives the lock chassis. These additional holes permit the passage of thru bolts which provide resistance and support against rotation of the support plates and which connect the lock roses covering the support plates.

In medium duty applications, for sake of simplicity, it is not generally necessary to utilize drilled holes outside of the door panel bore. Nevertheless, for strength reasons, it is still desirable to have bolts connecting the support plates to the lock chassis, along with thru bolts connecting the two exterior roses. However, this presents the problem that if the thru bolts connecting the roses and the fasteners connecting the support plate to the chassis are configured to pass separately within the diameter of the door panel bore, valuable space necessary for the lock assembly mechanisms are eliminated. Up to now, the only alternatives have been either: 1) reduce the space available for the lock mechanism so as to permit both sets of bolts to pass within the bore diameter, with the result of weakening the mechanism or making it less secure, or 2) drill extra holes outside of the bore diameter to accommodate the thru bolts for the roses, with the result of making installation more difficult.

Bearing in mind the problems and deficiencies of the prior art, it is therefore an object of the present invention to provide an improved lever handle lock assembly which is highly resistent to abuse, vandalism and damage in general.

It is another object of the present invention to provide a strengthened cylindrical lock assembly which is easily installed in conventional door opening without the necessity of drilling additional holes outside of the bore diameter.

It is a further object of the present invention to provide an improved cylindrical lock assembly which meets the above objects but which does not eliminate space in the lock chassis devoted to the lock mechanisms.

SUMMARY OF THE INVENTION

The above and other objects, which will be apparent to those skilled in the art, are achieved in the present invention which comprises a cylindrical lock assembly for mounting in a door panel having first and second sides and a transverse bore therethrough. The lock assembly includes a lock chassis, adapted to fit within the bore, having rotatable spindles extending therefrom for actuating a latch bolt upon rotation of the spindles. The chassis additionally has a support opening on at least the first side of the door panel. A support member, preferably a disk-shaped plate, having a diameter greater than the bore is mounted on at least the first side of the door panel and is adapted to be non-rotatably secured thereto. The support member has thereon an opening corresponding to and aligned with the chassis support opening. A support member fastener having a hollow, elongated body with an internal opening extending along its length is adapted to fit through the support member opening and into the chassis support opening to non-rotatably secure the chassis to the support member. A rose through which a spindle extends for mounting on the door panel on the exterior side of the support member is securable to the lock assembly by an elongated rose fastener extending through the hollow support member fastener.

Preferably, the support member fastener and the support opening in the chassis are complimentarily threaded. The support member may have at least one opening near its periphery such that a screw fastener may be inserted through the support member peripheral opening for non-rotatably securing the support member to the door panel.

The preferred embodiment of the invention further includes a second rose on the second side of the door panel and a second support member beneath the second rose which is then non-rotatably secured to the lock chassis and door panel. The second support member has an opening therein for passage of the rose fastener so that the first rose may be secured by the rose fastener to the second rose. The support member fastener may be threaded to be received in a complimentarily threaded opening in the chassis, and the rose fastener is threaded to be received in a complimentarily threaded opening in the second rose. The lock assembly is especially intended for use where a lever handle is employed for rotating the spindles to and extra torque may be applied to the assembly.

DETAILED DESCRIPTION OF THE INVENTION

Figure 1:
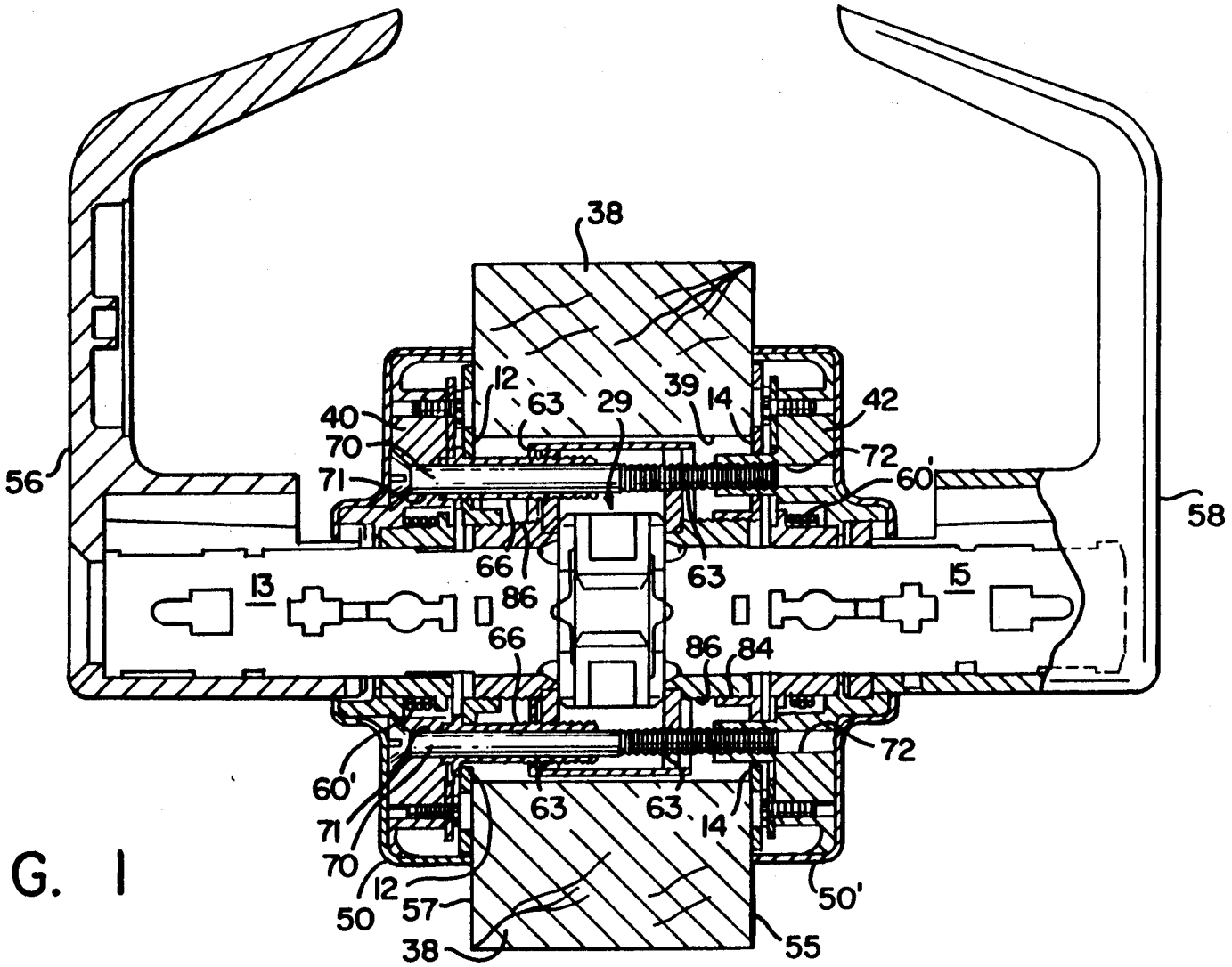
FIG. 1 is a cross sectional side view of an embodiment of the cylindrical lock assembly of the present invention along the axis of the spindle and lock chassis as it is secured in the bore of a door panel.
Figure 2:
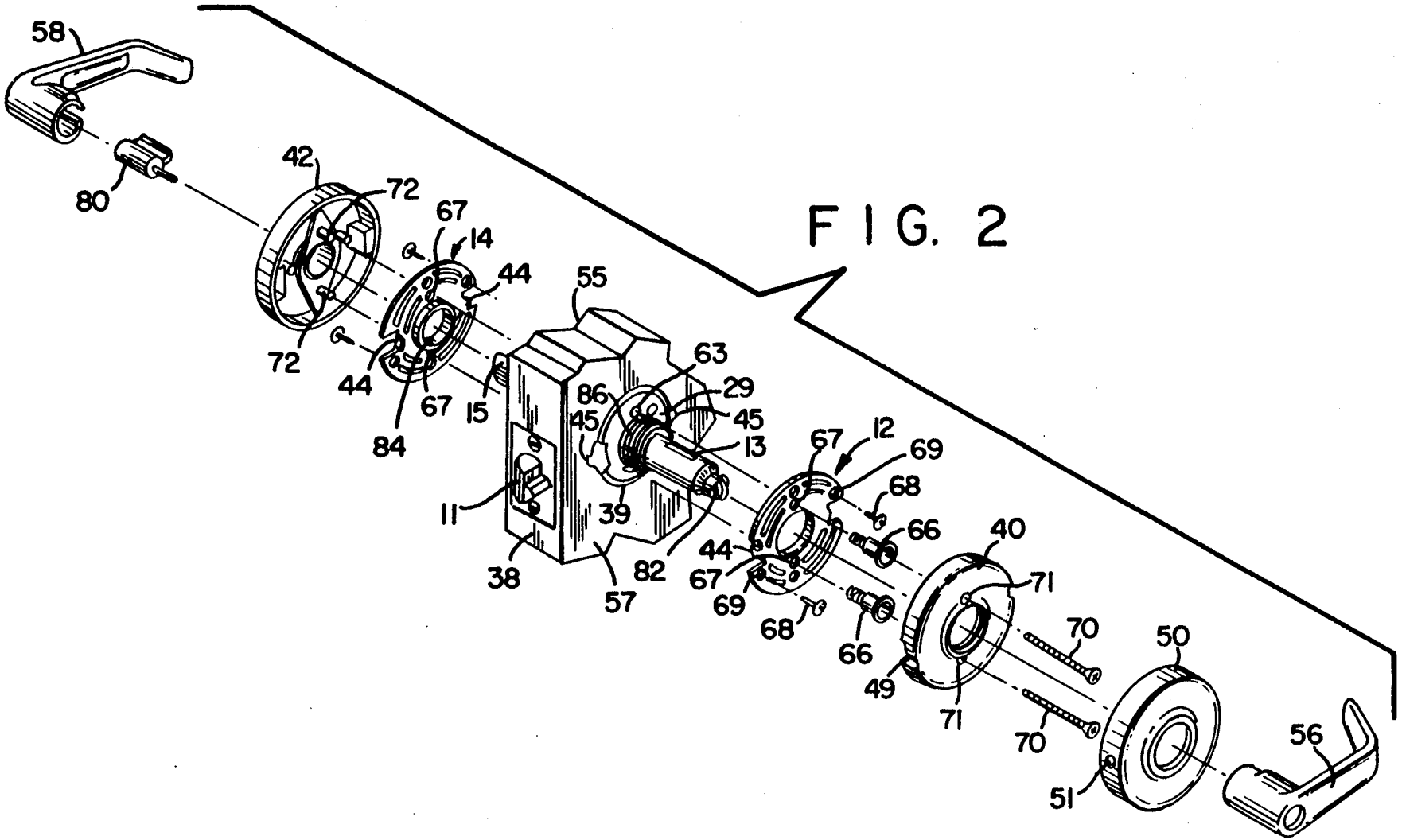
FIG. 2 is a perspective view, partially exploded, of the assembly of the interior portion of another embodiment of the cylindrical lock assembly of the present invention.
Figure 3:
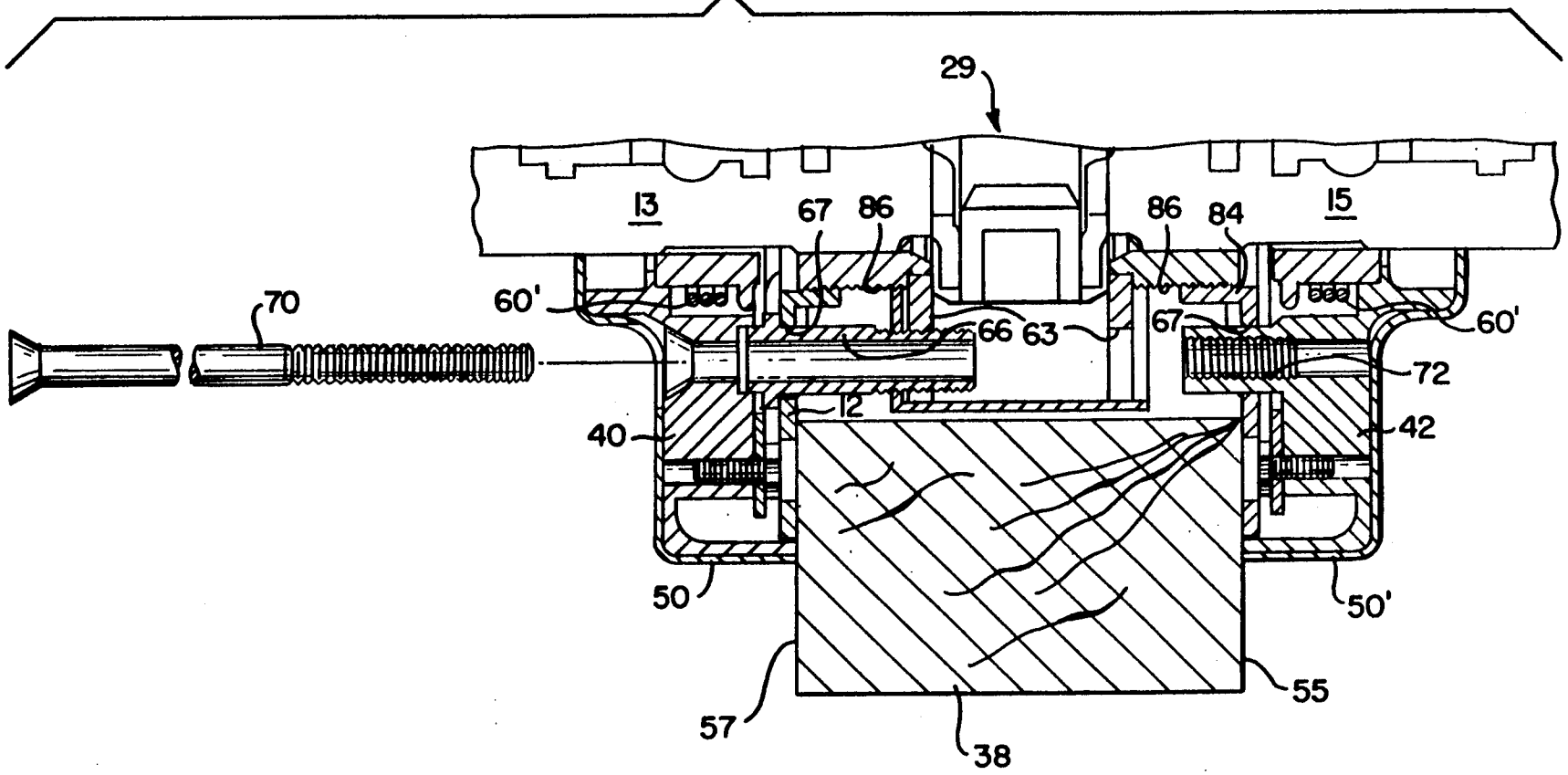
FIG. 3 is a close up sectional view of a portion of FIG. 1 with the rose fastener removed.

Reference is made herein to FIGS. 1–3 which illustrate the preferred embodiments of the present invention and in which like numerals refer to like features of the invention. Except where specifically noted, the components of the present invention are preferably made of steel, brass or such other conventional materials which possess the strength and wear characteristics for use in cylindrical lock assemblies.

FIG. 1 and 2 illustrate preferred embodiments of the present invention in cross sectional and exploded perspective views, respectively. These embodiments differ only slightly, in a manner to be explained further below.

In both embodiments, the lock assembly of the present invention is shown mounted in a door panel 38 which may be made of wood, steel or other conventional door materials, and which has a conventional transverse circular bore 39 between exterior door face 55 and interior door face 57. Disposed concentrically within bore 39 is a lock chassis 29 which has spindles 13 and 15 extending out from the interior and exterior sides of the door panel, respectively. Inside and outside lever handles 56 and 58 are respectively secured to spindles 13 and 15, and may also include conventional exterior key lock 80 and inside hand lock 82 mechanisms. The view in FIG. 1 shows these handles rotated out of their normal horizontal position. Although the present invention is considered to be most useful for lever handle applications where high amounts of torque may be applied via the handles, it is also useful for conventional round knob handle applications. A latch bolt assembly 11 is operable by the lock chassis 29 upon rotation of either of the spindles 13, 15 in their unlocked position.

To secure lock chassis 29 to door panel 38, a pair of support members or plates 12 and 14 are respectively disposed on interior face 57 and exterior face 55 of the door. Each support member is preferably of a planar, circular, disk shape of a diameter greater than the diameter of bore 39. The support plates have central annular openings for passage of the spindles. Inside support plate 12 is adapted to be non-rotatably secured to the door panel by screw fasteners 68 which pass through openings 69 in the support plates and are screwed into the door panel in suitable locations outside of the perimeter of bore 39. To provide further resistance to rotational stresses, support plates 12 and 14 include optional inwardly extending tabs 44 which are intended to mate with corresponding slots 45 at the periphery of door bore 39.

Lock chassis 29 is secured in a non-rotatable manner to the door panel 38 by a pair of support plate fasteners or bolts 66 which pass through holes or openings 67 provided in interior support member 12 and into corresponding aligned holes or openings 63 in chassis 29 which extend longitudinally through the entire length of the lock chassis. As will be discussed in more detail below, these support member fasteners 66 are hollow and are preferably threaded at their ends to mate with corresponding threads in chassis openings 63. The connection between exterior support plate 14 and lock chassis 29 is effected by an internally threaded sleeve 84 which defines the central opening and which mates with correspondingly threaded sleeve 86 which extends around the chassis spindle.

Disposed over the support members 12 and 14 are interior and exterior esctucheons or roses 40 and 42 respectively. To secure these roses to the lock assembly and to each other without having to drill additional holes through the door panel outside of the bore, and without sacrificing additional space inside the bore, a pair of elongated threaded fasteners 70 pass sequentially through opening 71 in interior rose 40, the central opening along the longitudinally axis of fastener 66, chassis opening 63, opening 67 in exterior support member 14, and finally into complimentarily threaded opening 72 in exterior rose 42. In this manner, the roses are securely fixed in a non-rotatable manner to the lock assembly and to each other without sacrificing space in the lock chassis, and without the necessity of extra drilling in the door panel outside of the bore opening 39.

As shown in more detail in FIG. 3, support member fastener 66 has a hollow elongated body with an interior opening extending along its full length. Fastener 66 is adapted to fit through the opening 67 in support member 12 so that the threaded end may be screwed into the corresponding opening 63 in chassis 29. Threaded bolt fastener 70 is then able to pass through the central opening of support member fastener 66 and through opening 63 in chassis 29 to secure the two roses to each other and to the lock assembly.

A decorative scalp 50 made of plated sheet metal is secured over and covers rose 40 to hide and protect the heads of threaded bolts 70. The scalp is secured on in a conventional manner by dimple 51 which fits tightly into slot 49 on rose 40. In this regard, FIG. 1 depicts an embodiment of the invention which also includes a decorative scalp 50' which serves to cover and protect exterior rose 42. Lever handles 56, 58 are maintained in their initial horizontal positions on the spindles by a torsion spring assembly 60' inside each of the roses which serve to return the handles to their initial position after unlatching.

To install the lock assembly of the present invention in a door panel, first a suitable bore opening 39 is prepared with or without the optional slots 45. The latch mechanism 11 is then installed. After assembly of exterior support plate 14, rose 42, lock cylinder 80 and exterior lever handle 58 over exterior spindle 15 and onto chassis 29, the chassis is then inserted into the bore from the outside of the door panel to engage the latch assembly. Interior support plate 12 is fitted over interior spindle 13 and hollow fasteners 66 are installed to secure support plate 12 to the lock chassis. At that point, screw fasteners 68 are then screwed into the opening 69 in the outer periphery of the interior support plate to anchor and secure it to the door panel surface outside of bore 39. Rose 40 is then installed utilizing the threaded bolts 70 which pass through hollow fastener 66 and the interior of lock chassis 29 to rose 42. Finally, lever handle 56 is installed over spindle 13.

Thus, the present invention provides a secure cylindrical lock assembly for at least medium duty applications which may be secured to the door panel to resist rotational forces on the lever handles. The unique construction of the present invention permits the same space be utilized for both the support plate fasteners and the roses fasteners to avoid extra drilling and/or loss of lock mechanism space within the bore.

While this invention has been described with reference to specific embodiments, it will be recognized by those skilled in the art that variations are possible without departing from the spirit and scope of the invention, and that it is intended to cover all changes and modifications of the invention disclosed herein for the purposes of illustration which do not constitute departure from the spirit and scope of the invention.

Having thus described the invention, what is claimed is:

1. A lock assembly for mounting in a door panel having first and second sides and a transverse bore therethrough comprising:

a lock chassis, adapted to fit within said bore, having rotatable spindles extending therefrom for actuating a latch bolt upon rotation of said spindles, said chassis having a support opening on at least said first side of said door panel;

a support member, having a diameter greater than said bore, on at least said first side of said door panel and adapted to be non-rotatably secured thereto, said support member having thereon an opening corresponding to said chassis support opening;

a support member fastener having a hollow, elongated body with an internal opening extending along its length, said support member fastener being adapted to extend through said support member opening and into said chassis support opening to non-rotatably secure said chassis to said support member;

a rose through which a spindle extends for mounting on said door panel over said support member, said rose being securable to the lock assembly by an elongated rose fastener extending through said hollow support member fastener.

2. The lock assembly of claim 1 wherein said support member fastener and said support opening in said chassis are complimentarily threaded.

3. The lock assembly of claim 1 wherein said support member has at least one opening near its periphery and further including a screw fastener for insertion through the support member peripheral opening for non-rotatably securing said support member to said door panel.

4. The lock assembly of claim 1 further including a second rose on said second side of said door panel, the first rose being secured by said rose fastener to said second rose.

5. The lock assembly of claim 4 further including a second support member beneath said second rose on the second side of said door panel, said second support member being non-rotatably securable to said lock chassis and door panel, and having an opening therein for passage of said rose fastener.

6. The lock assembly of claim 4 wherein said support member fastener is threaded to be received in a complimentarily threaded opening in said chassis, and wherein said rose fastener is threaded to be received in a complimentarily threaded opening in said second rose.

7. The lock assembly of claim 1 further including a lever handle for rotating one of said spindles.

8. The lock assembly of claim 6 further including a spring assembly mounted in said rose for returning the spindle and lever handle to an initial position after

9. The lock assembly of claim 1 wherein said support member is a plate.

10. A cylindrical lock assembly for mounting in door panel having first and second sides and a transverse bore therethrough comprising:

a lock chassis, adapted to fit within said bore, having rotatable spindles extending therefrom for actuating a latch bolt upon rotation of said spindles, said chassis having a support opening on at least said first side of said door panel;

a support plate, having a diameter greater than said bore, on at least said first side of said door panel and adapted to be non-rotatably secured thereto, said support plate having therein an opening corresponding to said chassis support opening;

a support plate fastener having a hollow, elongated body with an internal opening extending along its length, said support plate fastener being adapted to extend through said support plate opening and into said chassis support opening to non-rotatably secure said chassis to said support plate;

a rose through which a spindle extends for mounting on each side of said door panel, the rose on the first side of said door panel covering said support plate, said roses being securable to the lock assembly by an elongated rose fastener extending from the rose on said first panel side through said hollow support plate fastener to the rose on said second panel side.

11. The lock assembly of claim 10 wherein said support plate fastener is threaded to be received in a complimentarily threaded opening in said chassis, and wherein said rose fastener is threaded to be received in a complimentarily threaded opening in said second rose.

12. The lock assembly of claim 10 wherein said support plate has at least one opening near its periphery and further including a screw fastener for insertion through the support plate peripheral opening for non-rotatably securing said support plate to said door panel.

13. The lock assembly of claim 10 further including a second support plate beneath the rose on the second side of said door panel, said second support plate being non-rotatably securable to said lock chassis and door panel, and having an opening therein for passage of said rose fastener.

14. The lock assembly of claim 10 further including a lever handle for rotating one of said spindles.

15. The lock assembly of claim 14 further including a spring assembly mounted in said rose for returning the spindle and lever handle to an initial position after rotation.

16. A cylindrical lock assembly for mounting in door panel having first and second sides and a transverse bore therethrough comprising:

a lock chassis, adapted to fit within said bore, having rotatable spindles extending therefrom for actuating a latch bolt upon rotation of said spindles, said chassis having a support opening extending to each side of said door panel;

a support plate, having a diameter greater than said bore, on each side of said door panel and adapted to be non-rotatably secured thereto, said support plates having therein an opening corresponding to said chassis support opening;

a support plate fastener having a hollow, elongated body with an internal opening extending along its length, said support plate fastener being adapted to extend through the opening in at least one of said support plates and into said chassis support opening to non-rotatably secure said chassis to said support plate;

a rose through which a spindle extends for mounting on each side of said door panel, the rose on each side of said door panel covering the support plate, said roses being securable to the lock assembly by an elongated rose fastener extending from the rose on said first panel side through said hollow support plate fastener to the rose on said second panel side.

17. The lock assembly of claim 16 wherein said support plate fastener is threaded to be received in a complimentarily threaded opening in said chassis, and wherein said rose fastener is threaded to be received in a complimentarily threaded opening in said second rose.

18. The lock assembly of claim 16 wherein said support plate has at least one opening near its periphery and further including a screw fastener for insertion through the support plate peripheral opening for non-rotatably securing said support plate to said door panel.

19. The lock assembly of claim 16 further including a lever handle for rotating one of said spindles.

20. The lock assembly of claim 19 further including a spring assembly mounted in said rose for returning the spindle and lever handle to an initial position after rotation.

* * * * *